US012607178B2

(12) United States Patent
Tsuboi et al.

(10) Patent No.: US 12,607,178 B2
(45) Date of Patent: Apr. 21, 2026

(54) GAS COOLER

(71) Applicant: KOBELCO COMPRESSORS CORPORATION, Tokyo (JP)

(72) Inventors: Noboru Tsuboi, Hyogo (JP); Hajime Nakamura, Hyogo (JP); Junichiro Totsuka, Hyogo (JP); Kazuya Hirata, Hyogo (JP)

(73) Assignee: KOBELCO COMPRESSORS CORPORATION, Tokyo (JP)

( * ) Notice: Subject to any disclaimer, the term of this patent is extended or adjusted under 35 U.S.C. 154(b) by 365 days.

(21) Appl. No.: 18/261,756

(22) PCT Filed: Jan. 13, 2022

(86) PCT No.: PCT/JP2022/000947
§ 371 (c)(1),
(2) Date: Jul. 17, 2023

(87) PCT Pub. No.: WO2022/158371
PCT Pub. Date: Jul. 28, 2022

(65) Prior Publication Data

US 2024/0077068 A1 Mar. 7, 2024

(30) Foreign Application Priority Data

Jan. 25, 2021 (JP) ..... 2021-009556

(51) Int. Cl.
*F04B 39/06* (2006.01)
*F04B 39/12* (2006.01)
(Continued)

(52) U.S. Cl.
CPC ..... *F04B 39/06* (2013.01); *F04B 39/123* (2013.01); *F04B 53/04* (2013.01); *F04C 29/04* (2013.01)

(58) Field of Classification Search
CPC ..... F04B 39/06; F04B 39/123; F04B 53/04; F04B 39/121; F04B 39/16; F04C 29/04; F04C 2240/30
See application file for complete search history.

(56) References Cited

U.S. PATENT DOCUMENTS 6,572,350 B2 6/2003 Takahashi et al.
6,679,689 B2 1/2004 Takahashi et al.
(Continued)

FOREIGN PATENT DOCUMENTS

JP S56-95327 U 7/1981
JP S63-9598 U 1/1988
(Continued)

OTHER PUBLICATIONS

International Preliminary Report On Patentability and Written Opinion issued in PCT/JP2022/000947; mailed on Aug. 3, 2023.
(Continued)

*Primary Examiner* — Dung H Bui
(74) *Attorney, Agent, or Firm* — Studebaker Brackett PLLC

(57) ABSTRACT

A gas cooler includes a drain recovery part, a drain discharge flow path, a drain tank, and a ventilation flow path. In the drain recovery part, drain separated from gas is accumulated by cooling the gas in a cooling part. The drain tank includes a separation part in which the drain and the gas are separated, and a storage part in which the separated drain is stored. The drain discharge flow path has one end communicating with the drain recovery part and the other end communicating with the separation part. The ventilation flow path has one end communicating with the separation part, and the other end communicating with a gas flow path that leads to a downstream space above the drain recovery part and to a gas lead-out port.

11 Claims, 9 Drawing Sheets

(51) Int. Cl.
*F04B 53/04* (2006.01)
*F04C 29/04* (2006.01)

(56) References Cited

U.S. PATENT DOCUMENTS

| | | | | |
|---|---|---|---|---|
| 2002/0001531 | A1 | 1/2002 | Takahashi et al. | |
| 2002/0081213 | A1 | 6/2002 | Takahashi et al. | |
| 2017/0071424 | A1* | 3/2017 | Mitchell | A47K 13/10 |
| 2018/0369731 | A1* | 12/2018 | Mueller | B01D 45/16 |
| 2022/0288709 | A1* | 9/2022 | Hua | B01D 46/24 |
| 2024/0077068 | A1* | 3/2024 | Tsuboi | F04B 39/06 |

FOREIGN PATENT DOCUMENTS

| | | | |
|---|---|---|---|
| JP | H06-280747 | A | 10/1994 |
| JP | 2002-021759 | A | 1/2002 |

OTHER PUBLICATIONS

International Search Report issued in PCT/JP2022/000947; mailed Mar. 15, 2022.

* cited by examiner

GAS COOLER

CROSS-REFERENCE TO RELATED APPLICATIONS

This is a national phase application in the United States of International Patent Application No. PCT/JP2022/000947 with an international filing date of Jan. 13, 2022, which claims priority of Japanese Patent Application No. 2021-009556 filed on Jan. 25, 2021 the contents of which are incorporated herein by reference.

TECHNICAL FIELD

The present disclosure relates to a gas cooler.

BACKGROUND ART

In a gas cooler for compressor disclosed in gas introduced from a gas introduction port into the inside of a compressor is cooled by a heat exchanger and led out from the gas lead-out port. Liquid (drain) in the gas condensed by cooling is accumulated in a drain recovery part provided at a bottom part of the gas cooler and is discharged to the outside from an opening (drain discharge port) provided in a casing of the gas cooler. In a case where the flow path cross-sectional area of the gas in the casing and the size of the drain discharge port are not appropriately set or cannot be appropriately set due to structural constraints or the like, there is a possibility that the drain accumulated in the drain recovery part flows while accompanying the flow of the gas and reaches, for example, a second-stage compressor main body.

SUMMARY OF THE INVENTION

Problems to be Solved by the Invention

An object of the present disclosure is to provide a gas cooler that efficiently discharges drain to the outside of a casing regardless of the flow path cross-sectional area of a gas flow path in the casing.

Means for Solving the Problems

The present disclosure provides a gas cooler including: a casing provided with a gas introduction port and a gas lead-out port; a cooling part that is provided in an inside of the casing, partitions the inside of the casing into an upstream space in which the gas introduction port is opened and a downstream space communicating with the gas lead-out port, and cools gas introduced into the inside of the casing; a drain recovery part that is provided at a bottom part of the downstream space and accumulates drain separated from the gas by cooling the gas in the cooling part; a drain tank including a separation part into which the drain accumulated in the drain recovery part is introduced together with a part of the gas and that separates the drain and the gas, a storage part that stores the drain that has been separated, and a drain discharge port configured to discharge the drain from the storage part; a drain discharge flow path having one end communicating with the drain recovery part and the other end communicating with the separation part; and a ventilation flow path having one end communicating with the separation part, and the other end communicating with a gas flow path that leads to the downstream space above the drain recovery part and to the gas lead-out port.

According to the gas cooler of the present disclosure, the gas discharged from the compressor main body and having reached the drain recovery part flows only in the casing from the drain recovery part, and is divided into a first flow reaching the gas lead-out port and a second flow joining the first flow after passing through the drain tank from the drain recovery part. Because the drain accumulated in the drain recovery part is guided to the separation part of the drain tank together with the gas by the second flow, the drain can be suppressed from being guided to the gas lead-out port accompanying the first flow. In addition, the drain guided to the drain tank together with the gas by the second flow is separated into the gas and the drain in the separation part, the separated drain is accumulated in the storage part, and the separated gas joins the first flow through the ventilation flow path. Therefore, the drain can be suppressed from reaching the gas lead-out port accompanying the second flow. In addition, because the gas guided into the inside of the drain tank returns to the gas flow path via the ventilation flow path, loss of the gas due to gas leakage can be suppressed.

The gas flow path may include a first gas flow path extending upward from the drain recovery part and connecting the downstream space with the gas lead-out port, and the other end of the ventilation flow path may communicate with the first gas flow path.

For example, the first gas flow path, the separation part, the drain discharge flow path, and the ventilation flow path may have flow path cross-sectional areas having the following relationship.

$$A2>A1>A3>A4$$

A1: A flow path cross-sectional area of the first gas flow path

A2: A flow path cross-sectional area of the separation part

A3: A flow path cross-sectional area of the drain discharge flow path

A4: A flow path cross-sectional area of the ventilation flow path

The velocities of gas in the first gas flow path and the separation part may have the following relationship.

$$U1=V1/A1 \text{ (m/sec)}<U \text{ (m/sec)}$$

$$U2=V2/A2 \text{ (m/sec)}<U \text{ (m/sec)}$$

$$V=V1+V2$$

U: A terminal velocity

U1: A velocity of gas in the first gas flow path

U2: A velocity of gas in the separation part

V: A flow rate of gas guided to the drain recovery part

V1: A flow rate of gas guided to the first gas flow path

V2: A flow rate of gas guided to the separation part

For example, in a case where the casing is an existing component, the value of the flow path cross-sectional area A1 is fixed. In addition, the value of the flow rate V of the gas discharged from the compressor main body and guided to the drain recovery part is also fixed according to the usage condition of the compressor, for example, a customer request. Even under such conditions, by decreasing the flow rate V1 of the gas guided to the first gas flow path, that is, by increasing the flow rate V2 of the gas guided to the separation part, the velocity U1 of the gas in the first gas flow path can be less than the terminal velocity U. Further, the flow path cross-sectional areas A2 to A4 of the drain discharge flow path, the drain tank, and the ventilation flow path can be optionally set within a range satisfying the above relationship. Therefore, for example, even if the flow rate V2 is increased by increasing the flow path cross-sectional area A4, the velocity U2 of the gas in the separation part can be set to be less than the terminal velocity U by increasing the flow path cross-sectional area A2. As described above, because each of the velocity U1 and the velocity U2 can be less than the terminal velocity U, the drain can be suppressed from accompanying the flow of the gas and reaching the gas lead-out port.

The drain tank may have an inner bottom surface whose position in a height direction is relatively lower than a position of an inner bottom surface of the casing in the height direction, the drain discharge flow path may be opened on a side of the casing so as to include the position of the inner bottom surface of the casing in the height direction, and the drain discharge flow path may have a bottom surface that is horizontal or downwardly inclined toward a side of the drain tank.

According to the above configuration, the drain can be quickly guided from the drain recovery part to the drain tank. Therefore, retention of the drain in the drain recovery part can be reduced, and the drain can be further suppressed from reaching the gas lead-out port.

The gas cooler may include a throttle valve that adjusts a flow rate of the gas passing through the ventilation flow path.

According to the above configuration, the flow rate V2 is appropriately set by adjusting the aperture of the throttle valve, and the velocity U1 and the velocity U2 can be adjusted.

The gas cooler may include a porous plate that covers the upper part of the drain stored in the storage part in the drain tank.

According to the above configuration, because the drain stored in the storage part can be suppressed from being lifted by the flow of the gas, the drain can be more effectively suppressed from reaching the gas lead-out port via the ventilation flow path.

The other end of the ventilation flow path may be opened to the atmosphere instead of communicating with the gas lead-out port.

According to the above configuration, even in a case where the second flow cannot be returned to the first flow, the drain can be stored in the storage part.

According to the gas cooler of the present disclosure, the drain can be efficiently discharged to the outside of the casing regardless of the flow path cross-sectional area of the gas flow path in the casing.

MODE FOR CARRYING OUT THE INVENTION

First Embodiment

A compressor 1 of the present embodiment is an oil-free two-stage screw compressor. As the handling gas, air is described below as an example.

Figure 1:
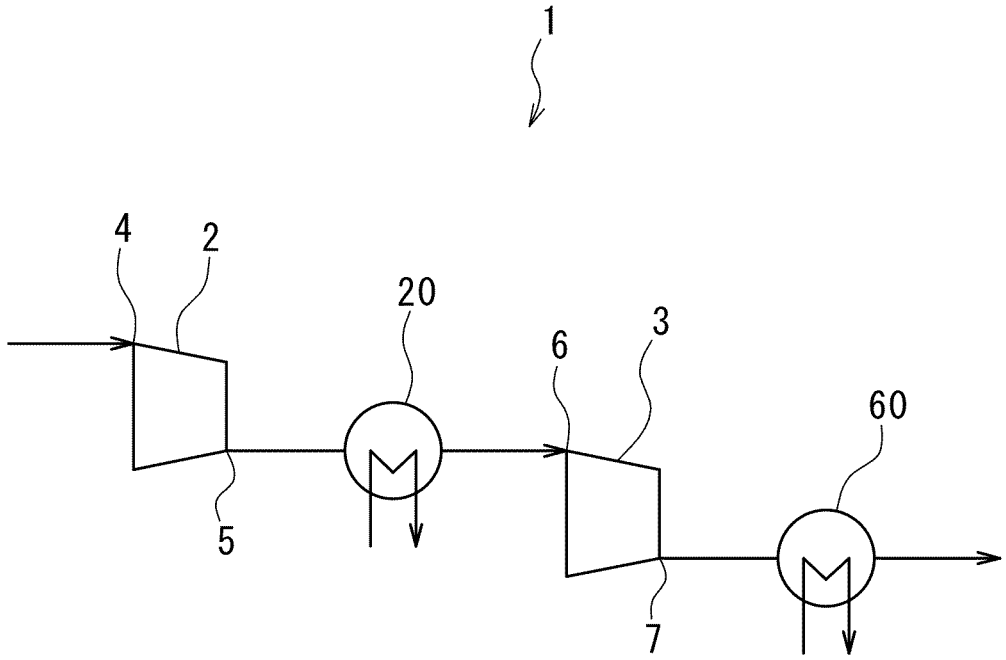
FIG. 1 is a schematic configuration diagram of a compressor according to one embodiment of the present invention.

Referring to FIG. 1, the compressor 1 includes a first-stage compressor main body 2, a second-stage compressor main body 3, an intercooler 20, and an aftercooler 60. In the present embodiment, in the air flow path, the first-stage compressor main body 2, the intercooler 20, the second-stage compressor main body 3, and the aftercooler 60 are arranged in this order and are fluidly connected.

The first-stage compressor main body 2 sucks air from the suction port 4 opened to the atmosphere, compresses the air in the inside thereof, and discharges the air from a discharge port 5. The compressed air discharged from the discharge port 5 is sent to a suction port 6 of the second-stage compressor main body 3 via the intercooler 20.

Figure 2:
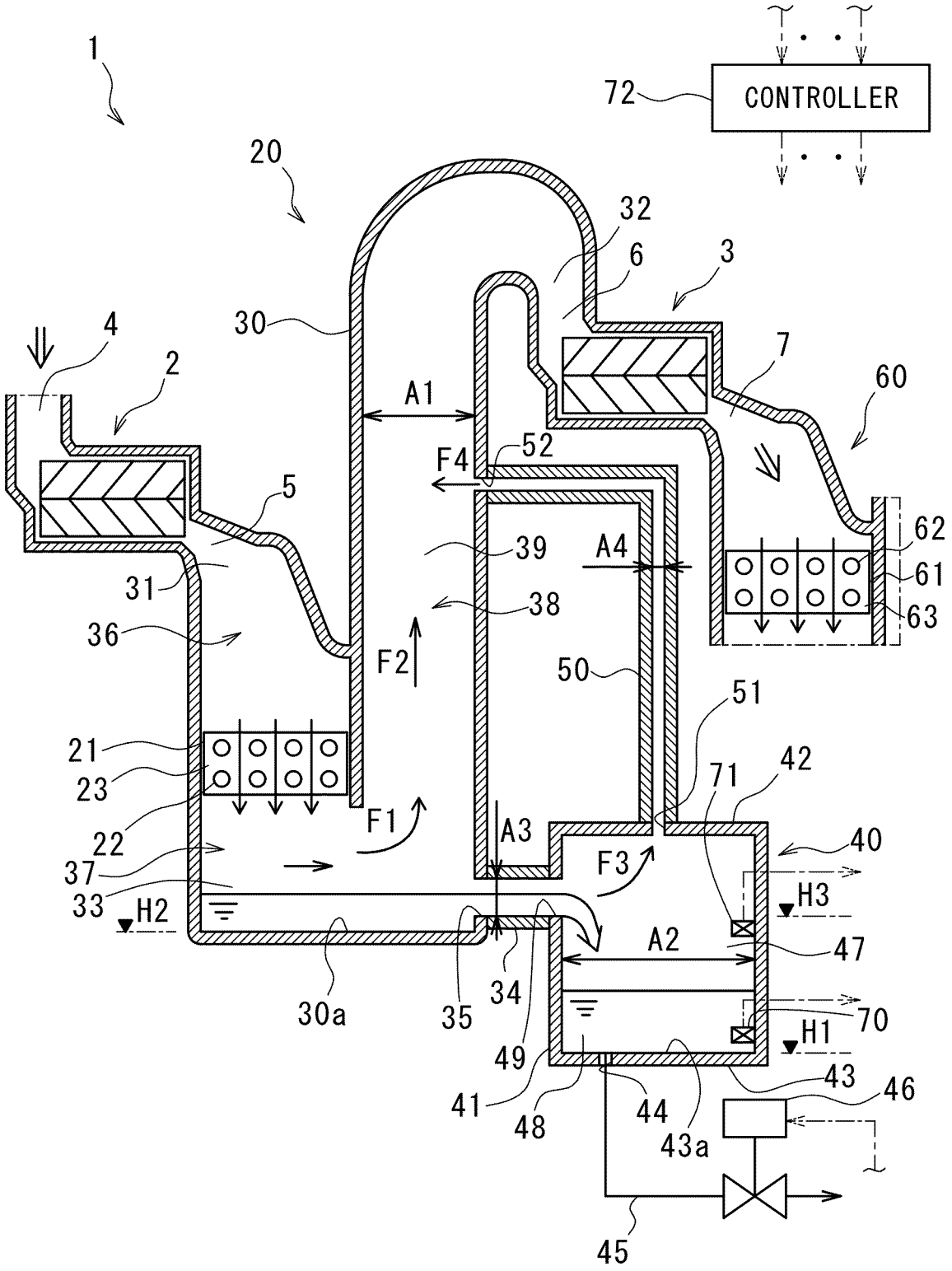
FIG. 2 is a schematic configuration diagram of a compressor including a gas cooler according to a first embodiment of the present invention.

Referring also to FIG. 2, the intercooler 20 is interposed between the first-stage compressor main body 2 and the second-stage compressor main body 3. The intercooler 20 is provided with a cooling part 21. In the cooling part 21, heat exchange is performed between a cooling liquid from the outside and the air discharged from the first-stage compressor main body 2, and the air discharged from the first-stage compressor main body 2 is cooled. The air before passing through the cooling part 21 has a high temperature of, for example, about 180° C., but the air in the intercooler 20 after passing through the cooling part 21 is cooled to, for example, about 40° C. Therefore, the appropriately cooled compressed air is supplied to the second-stage compressor main body 3.

The second-stage compressor main body 3 sucks the compressed air supplied from the intercooler 20, compresses the compressed air in the inside thereof, and discharges the compressed air from a discharge port 7. Similarly to the intercooler 20, the compressed air discharged from the discharge port 7 is cooled by a cooling part 61 of the aftercooler 60 and supplied to a supply destination such as a factory.

In the above configuration, when the air is cooled in the inside of the intercooler 20 or the aftercooler 60, moisture in the air is condensed, and drain is generated in the inside of each of the intercooler 20 and the aftercooler 60. The drain flows into the second-stage compressor main body 3 or the supply destination along with the flow of air, which may cause a failure. However, in the present embodiment, the intercooler 20 and the aftercooler 60 each have a structure for removing the drain.

Hereinafter, a structure for removing the drain in the intercooler 20 is described. In the present embodiment, the aftercooler 60 also has the similar structure to the intercooler 20.

Referring to FIG. 2, the intercooler 20 (gas cooler) includes a casing 30, the cooling part 21, and a drain tank 40.

The casing 30 is provided with a gas introduction port 31 and a gas lead-out port 32. The gas introduction port 31 is connected to the discharge port 5 of the first-stage compressor main body 2. The gas lead-out port 32 is connected to the suction port 6 of the second-stage compressor main body 3.

The cooling part 21 is provided in the inside of the casing 30, and partitions the inside of the casing 30 into an upstream space 36 in which the gas introduction port 31 is opened and a downstream space 37 communicating with the gas lead-out port 32.

In addition, the cooling part 21 cools the air (gas) introduced into the inside of the casing 30. Specifically, the air is cooled by coming into contact with a tube nest 22 and a fin 23 and exchanging heat with the cooling water in the tube nest 22. When the air is cooled, moisture in the air condenses and falls into droplets to generate drain.

The casing 30 includes a drain recovery part 33 provided at a bottom part of the downstream space 37. In the drain recovery part 33, drain separated from the air (gas) by cooling the air (gas) in a cooling part 21 is accumulated.

In addition, the casing 30 also includes a gas flow path 38 that leads to the downstream space 37 above the drain recovery part 33 and to the gas lead-out port 32. The gas flow path 38 includes a first gas flow path 39 extending upward from the drain recovery part 33 and connecting the downstream space 37 and the gas lead-out port 32.

The drain tank 40 is a cylindrical hollow tank having a side wall 41, a top wall 42, and a bottom wall 43. The drain tank 40 includes a separation part 47 positioned in the upper part of the drain tank 40 and a storage part 48 positioned in the lower part of the drain tank 40 and in which the drain is stored as described later. A boundary between the storage part 48 and the separation part 47 is not fixed, and a gas phase space above the liquid level of the stored drain is the separation part 47. A height H1 of an inner bottom surface 43*a* of the drain tank 40 is relatively lower than a height H2 of an inner bottom surface 30*a* of the casing 30. Note that, in a case where the inner bottom surface 30*a* is not a horizontal flat surface, the height H2 is regarded as the lowest position on the inner bottom surface 30*a*.

Further, the drain tank 40 includes a drain discharge flow path 34 whose one end communicates with the drain recovery part 33 and the other end communicates with the separation part 47. That is, the drain discharge flow path 34 has one end connected to a drain outlet 35 provided at a portion of the drain recovery part 33 of the casing 30, and the other end connected to a drain inlet 49 provided at a portion of the separation part 47 of the side wall 41.

After the drain and the air pass through the drain discharge flow path 34, in the separation part 47, the drain accumulated in the drain recovery part 33 is introduced together with a part of the air (gas), the drain and the air (gas) are separated, and the separated drain is stored in the storage part 48. The depth of the storage part 48 is sufficiently deep from the drain inlet 49 to allow the drain to be stored without the drain inlet 49 being blocked.

The bottom wall 43 is provided with a drain discharge port 44 for discharging the drain from the storage part 48. A drain discharge pipe 45 is connected to the drain discharge port 44. The drain discharge pipe 45 is connected to an external pipe via a sealing mechanism 46. The sealing mechanism 46 is, for example, a valve such as an electromagnetic valve.

The intercooler 20 includes a ventilation flow path 50 for returning the air in the separation part 47 into the casing 30. The ventilation flow path 50 has one end connected to a gas outlet 51 provided in the top wall 42 of the drain tank 40, and the other end connected to a gas inlet 52 provided in the casing 30 in a portion of the gas flow path 38. That is, the ventilation flow path 50 has one end communicating with the separation part 47, and the other end communicating with the gas flow path 38. In other words, the other end of the ventilation flow path 50 communicates with the first gas flow path 39. The gas inlet 52 may be provided in the casing 30 in the most downstream portion of the first gas flow path 39.

Hereinafter, flows of the air and the drain are described in detail.

As described above, the compressed air discharged from the discharge port 5 of the first-stage compressor main body 2 is sent to the suction port 6 of the second-stage compressor main body 3 via the intercooler 20. In other words, the air flow from the gas introduction port 31 toward the gas lead-out port 32 is generated in the inside of the casing 30.

In the present embodiment, the air flowing from the gas introduction port 31 toward the gas lead-out port 32 is divided into a flow flowing only in the casing 30 and a flow passing through the drain tank 40. In other words, the air that has reached the drain recovery part 33 is divided into a first flow flowing through the first gas flow path 39 as indicated by arrows F1 and F2 and a second flow passing through the drain tank 40 as indicated by arrows F3 and F4.

The drain accumulated in the drain recovery part 33 is quickly guided to the separation part 47 together with the air by the second flow.

The drain guided to the separation part 47 together with the air is separated from the air and stored in the storage part 48 by its own weight. The air separated by the separation part 47 joins the first gas flow path 39 via the ventilation flow path 50 as indicated by the arrow F4. In addition, the drain stored in the storage part 48 is discharged from the drain discharge port 44 by opening the sealing mechanism 46 as necessary. That is, the sealing mechanism 46 is subjected to opening and closing control only to discharge the drain stored in the storage part 48. That is, the opening and closing control of the sealing mechanism 46 is not necessary to guide the drain from the drain recovery part 33 to the separation part 47.

In addition, by opening the sealing mechanism 46 so as to maintain a state where the drain is stored in the storage part 48, the air cannot leak from the sealing mechanism 46. Therefore, the control of opening and closing the sealing mechanism 46 for minimizing the air leak is not necessary. For example, a first water level sensor 70 that detects a decrease in drain to a predetermined lower limit level of the storage part 48 is provided in the lower half (for example, near H1) between the height H1 and a height H3, and a second water level sensor 71 that detects an increase in drain to a predetermined upper limit level of the storage part 48 is provided in the upper half (for example, near H3) between the height H1 and the height H3. Then, the controller 72 may perform the opening and closing control such that the sealing mechanism 46 (electromagnetic valve) closes when the first water level sensor 70 detects that the amount of drain storage has reached the lower limit level, and the sealing mechanism 46 (electromagnetic valve) opens when the second water level sensor 71 detects that the amount of drain storage has reached the upper limit level. Note that the first water level sensor 70 and the second water level sensor 71 may be replaced with one water level sensor that can continuously detect the water level from the lower limit level to the upper limit level. Further, in place of the second water level sensor 71, there may be provided a timer that can set an optional time from when the first water level sensor 70 detects that the amount of drain storage reaches the lower limit level to when the drain reaches the upper limit level, and the opening and closing control may be performed so as to open the sealing mechanism 46 (electromagnetic valve) after a predetermined set time has been counted. In addition, the sealing mechanism is not limited to the electromagnetic valve, and may be a free-float air trap 46*a* (see FIG. 3). According to the free-float air trap 46*a*, the electric opening and closing control itself is unnecessary, and thus automatic drain discharge can be performed without performing the opening and closing control.

As described above, the air having reached the drain recovery part 33 flows only in the casing 30 from the drain recovery part 33, and is divided into the first flow reaching the gas lead-out port 32 and the second flow joining the first flow after passing through the drain tank 40 from the drain recovery part 33.

Because the drain accumulated in the drain recovery part 33 is guided to the separation part 47 of the drain tank 40 together with the air by the second flow, the drain can be suppressed from being guided to the second-stage compressor main body 3 accompanying the first flow. In addition, the drain guided to the drain tank 40 together with the air by the second flow is separated into the air and the drain at the separation part 47, the separated drain is accumulated in the storage part 48, and the separated gas joins the first flow through the ventilation flow path 50. Therefore, the drain can be suppressed from reaching the second-stage compressor main body 3 accompanying the second flow. In addition, because the gas guided into the inside of the drain tank 40 returns to the gas flow path 38 via the ventilation flow path 50, loss of the gas due to gas leakage can be suppressed.

As described above, according to the gas cooler of the present embodiment, the drain can be efficiently discharged to the outside of the casing 30 regardless of the flow path cross-sectional area of the gas flow path in the casing 30. In addition, the drain can be discharged to the outside of the casing 30 without requiring the opening and closing control of the sealing mechanism 46 for discharging the drain to the outside of the casing 30 and the opening and closing control of the sealing mechanism 46 for minimizing the leakage of the air.

Hereinafter, the flows of air and drain are described in detail with reference to the flow path cross-sectional area A1 of the first gas flow path 39, the flow path cross-sectional area A2 of the separation part 47, the flow path cross-sectional area A3 of the drain discharge flow path 34, and the flow path cross-sectional area A4 of the ventilation flow path 50 with continued reference to FIG. 2. The flow path cross-sectional area refers to a cross-sectional area of each flow path substantially perpendicular to the direction in which a fluid flows when the fluid passes through each flow path. The flow path cross-sectional area A2 of the separation part 47 which is a gas phase space is the area of a horizontal cross section of an inner wall of the drain tank 40 in the separation part 47.

In the present embodiment, the flow path cross-sectional areas A1 to A4 of the first gas flow path 39, the separation part 47, the drain discharge flow path 34, and the ventilation flow path 50 have a relationship of the following equation (1).

$$A2>A1>A3>A4 \quad (1)$$

Because the flow path cross-sectional area A2 is set to be sufficiently larger than the flow path cross-sectional area A1, even if the velocity of the air is equal to or higher than the terminal velocity U in the first gas flow path 39, the velocity of the air can be less than the terminal velocity U in the separation part 47. Here, the terminal velocity U refers to the maximum velocity reached in balance with the air resistance when the droplet freely falls in the air, and may be set to, for example, about 5 m/sec.

Because the flow path cross-sectional area A3 is sufficiently larger than the flow path cross-sectional area A4, the drain accumulated in the drain recovery part 33 can be quickly guided to the separation part 47 together with the air by the second flow.

As described above, by making the flow path cross-sectional area A3 smaller than the flow path cross-sectional area A1 while making the size thereof to such an extent that the drain accumulated in the drain recovery part 33 can be quickly guided to the separation part 47, installation properties can be improved. That is, for example, the drain tank 40 and the like can be easily provided in the existing casing 30.

Hereinafter, by continuously referring to FIG. 2, the velocity U1 of the air (gas) in the first gas flow path 39, the velocity U2 of the air (gas) in the separation part 47, the flow rate V1 of the air (gas) guided to the first gas flow path 39, and the flow rate V2 of the air (gas) guided to the separation part 47 are described. Note that in the present description, the "flow rate" means a "volume flow rate (unit: m3/sec)".

In the present embodiment, the velocities of the air (gas) in the first gas flow path 39 and the separation part 47 has the relationship of the following equations (2) to (4).

$$U1=V1/A1 \text{ (m/sec)}<U \text{ (m/sec)} \quad (2)$$

$$U2=V2/A2 \text{ (m/sec)}<U \text{ (m/sec)} \quad (3)$$

$$V=V1+V2 \quad (4)$$

For example, in a case where the casing 30 is an existing component, the value of the flow path cross-sectional area A1 is fixed. In addition, the value of the flow rate V of the gas discharged from the first-stage compressor main body 2 and guided to the drain recovery part 33 is also fixed according to the usage condition of the compressor 1, for example, a customer request.

Even under such conditions, by decreasing the flow rate V1 of the gas guided to the first gas flow path 39, that is, by increasing the flow rate V2 of the gas guided to the separation part 47, the velocity U1 of the gas in the first gas flow path 39 can be less than the terminal velocity U.

Further, the flow path cross-sectional areas A2 to A4 of the drain discharge flow path 34, the drain tank 40, and the ventilation flow path 50 can be optionally set within a range satisfying the above relationship. Therefore, for example, even if the flow rate V2 is increased by increasing the flow path cross-sectional area A4, the velocity U2 of the gas in the separation part 47 can be set to be less than the terminal velocity U by increasing the flow path cross-sectional area A2.

As described above, because each of the velocity U1 and the velocity U2 can be less than the terminal velocity U, the drain can be suppressed from accompanying the flow of the gas and reaching the second-stage compressor main body 3.

Hereinafter, second to sixth embodiments of the present invention are described. Regarding these embodiments, points not specifically mentioned are similar to those of the first embodiment described above. In the drawings relating to these embodiments, the same elements as those of the first embodiment are denoted by the same reference numerals as those of the first embodiment.

Second Embodiment

Figure 3:
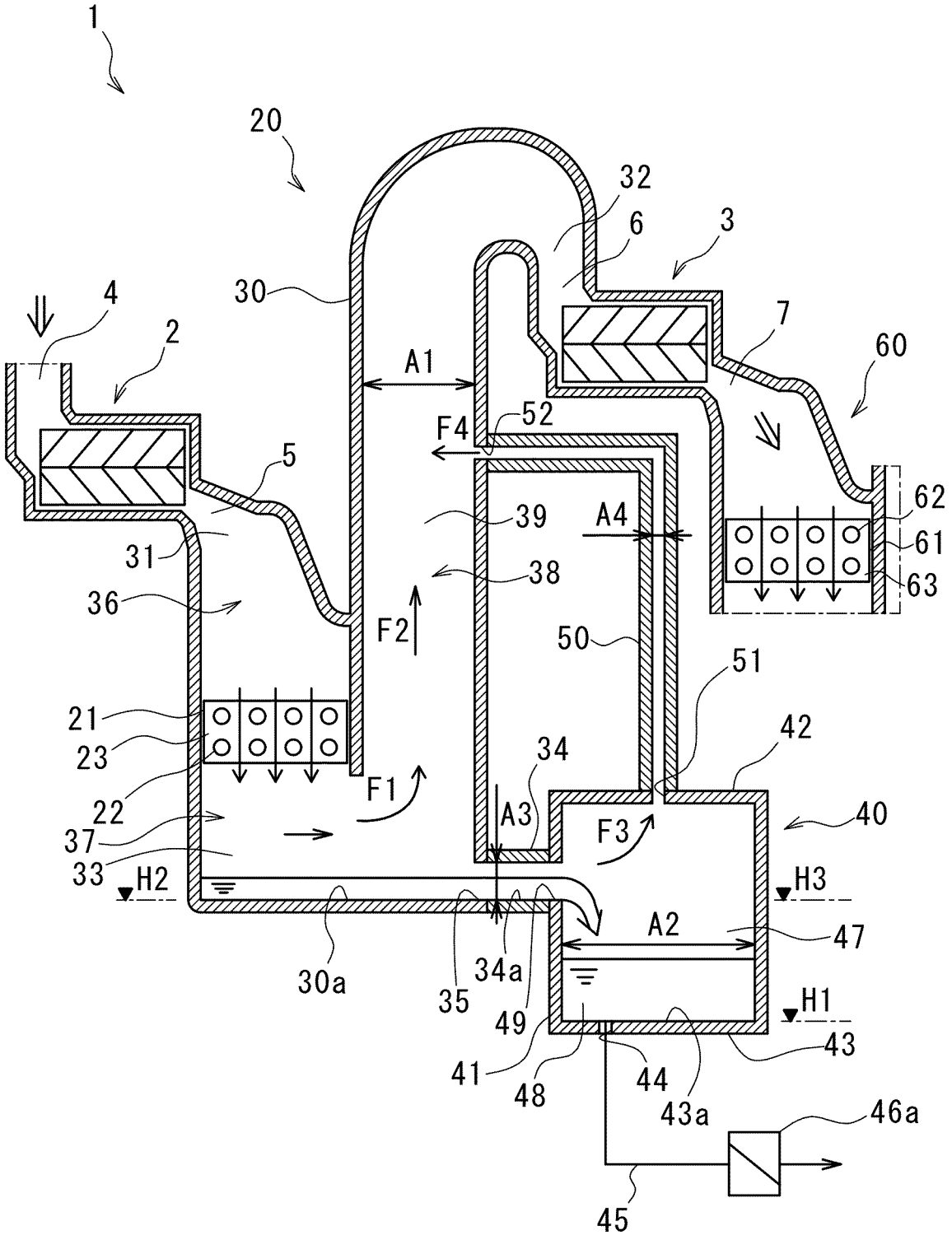
FIG. 3 is a schematic configuration diagram of a compressor including a gas cooler according to a second embodiment of the present invention.

Referring to FIG. 3, in an intercooler 20 in the second embodiment, a height H3 of a bottom surface 34*a* of a drain discharge flow path 34 is the same as a height H2 of an inner bottom surface 30*a* of a casing 30. That is, the drain discharge flow path 34 is opened so as to include a position H2 in the height direction of the inner bottom surface 30*a* of the casing 30 on the casing 30 side, and the bottom surface 34*a* of the drain discharge flow path 34 is horizontal. In addition, in the intercooler 20 according to the second embodiment, a free-float air trap 46*a* is provided instead of the sealing mechanism 46.

In the second embodiment, the resistance to the flow of the drain from a drain recovery part 33 to a drain tank 40 is reduced, and the drain can be quickly guided. Therefore, retention of the drain in the drain recovery part 33 can be reduced, and the drain can be further suppressed from reaching the gas lead-out port 32. In addition, according to the free-float air trap 46*a*, the electric opening and closing control itself is unnecessary, and thus automatic drain discharge can be performed without performing the opening and closing control.

Figure 4:
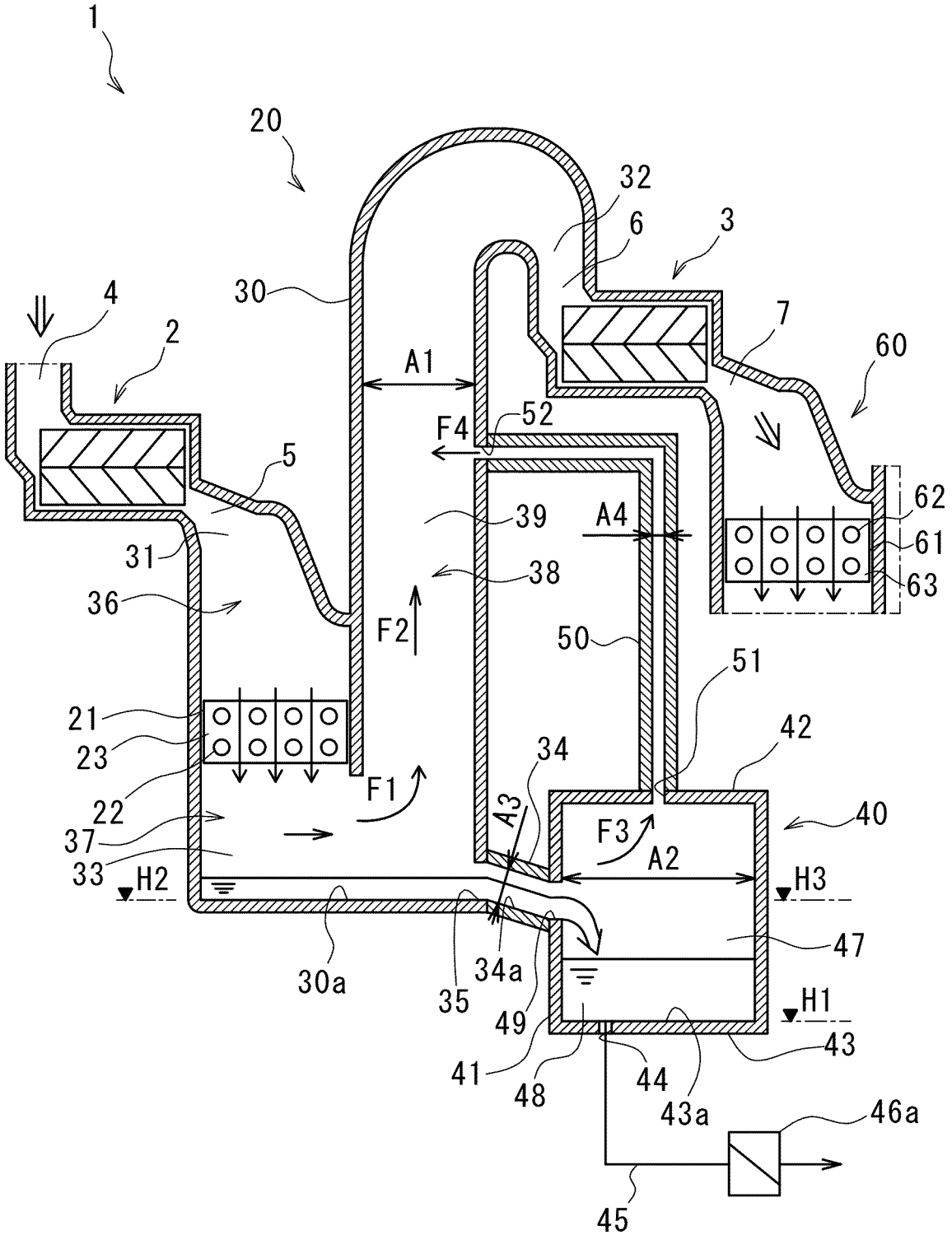
FIG. 4 is a schematic diagram showing a modification of the second embodiment of the present invention.

As shown in FIG. 4, in the modification of the second embodiment, the bottom surface 34*a* of the drain discharge flow path 34 is inclined downward toward the drain tank 40.

In the modification of the second embodiment, a downward force due to gravity is also applied, and the drain can be guided to the drain tank 40 more quickly.

Third Embodiment

Figure 5:
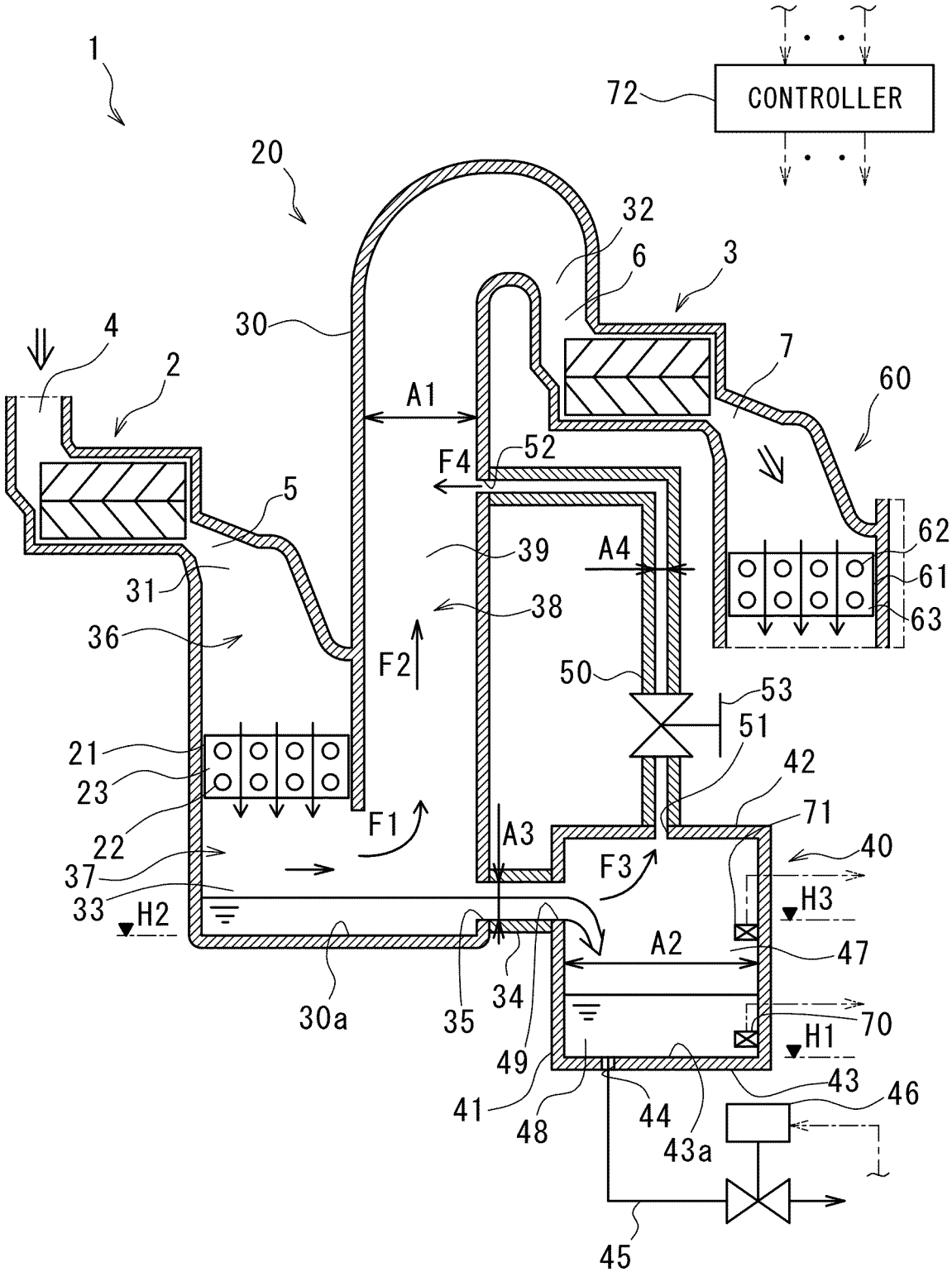
FIG. 5 is a schematic configuration diagram of a compressor including a gas cooler according to a third embodiment of the present invention.

Referring to FIG. 5, an intercooler 20 in the third embodiment includes a throttle valve 53 that adjusts the flow rate of the gas passing through a ventilation flow path 50.

The throttle valve 53 has a function of adjusting the flow rate of the air passing through the ventilation flow path 50. Therefore, the flow rate V2 is appropriately set by adjusting the aperture of the throttle valve 53, and the velocity U1 and the velocity U2 can be adjusted.

Fourth Embodiment

Figure 6:
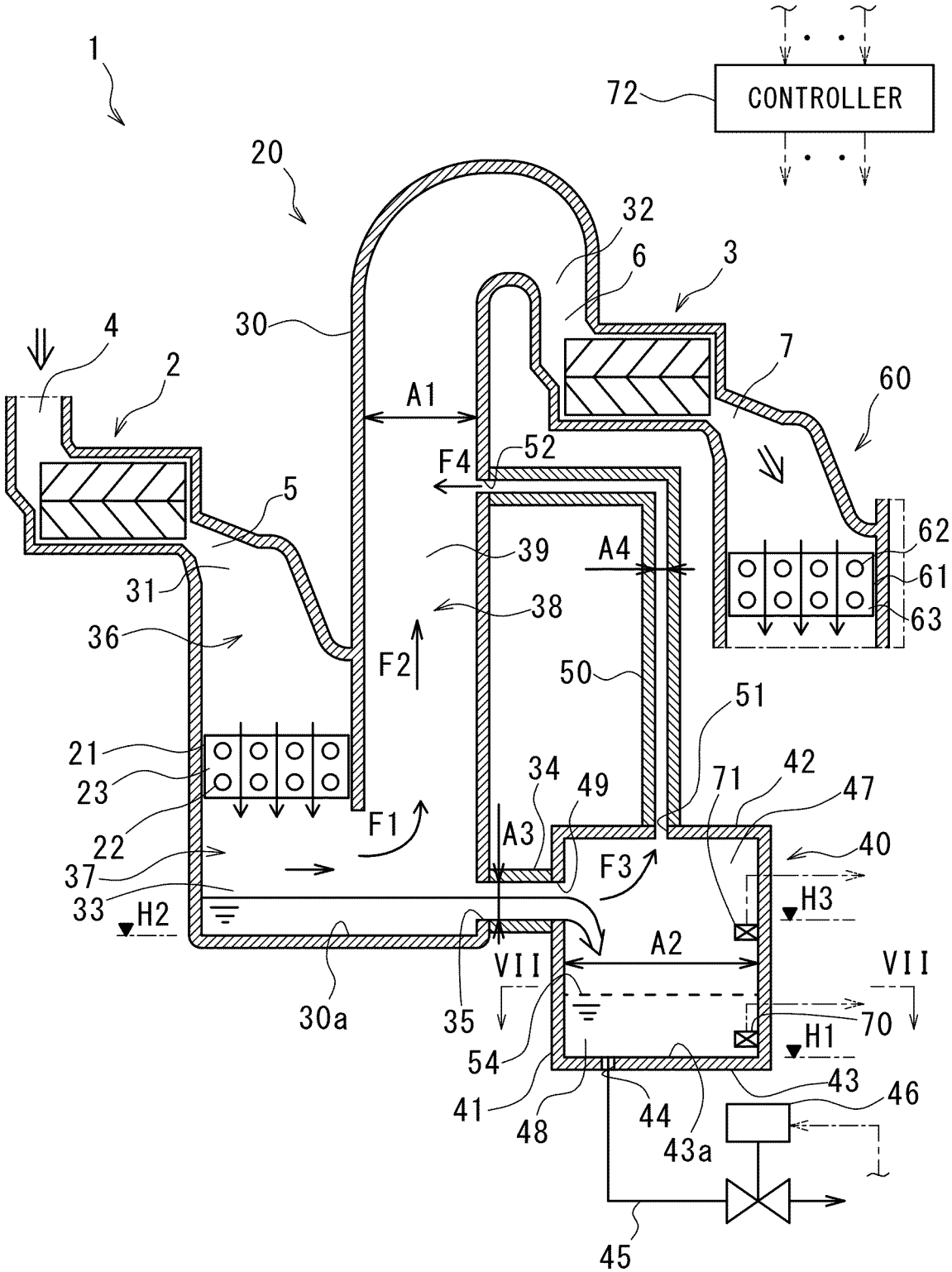
FIG. 6 is a schematic configuration diagram of a compressor including a gas cooler according to a fourth embodiment of the present invention.
Figure 7:
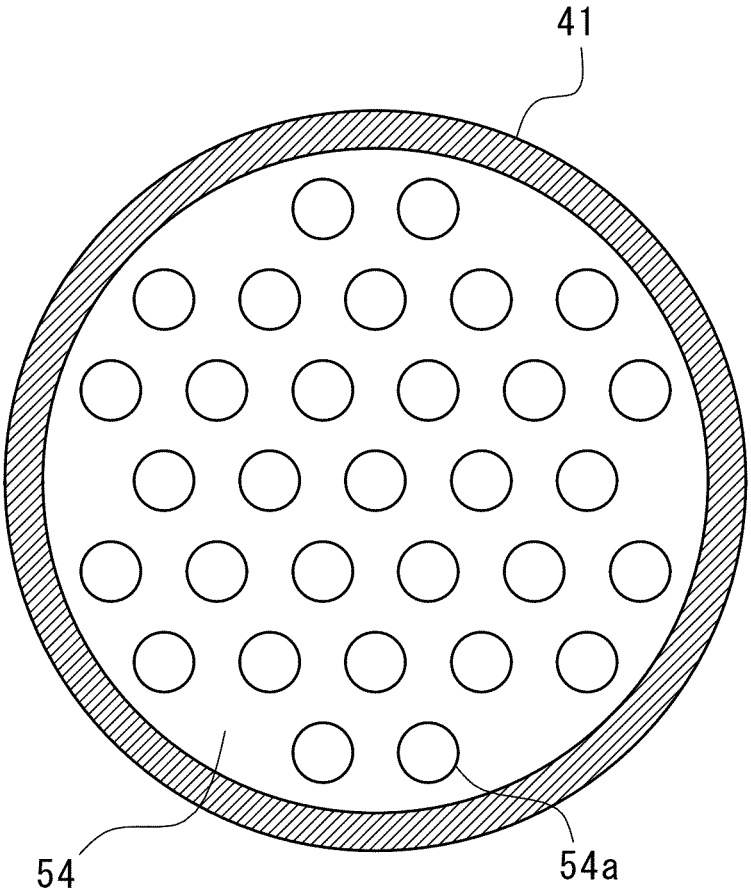
FIG. 7 is a cross-sectional view taken along a line VII-VII in FIG. 6.

Referring to FIGS. 6 and 7, the intercooler 20 in the fourth embodiment includes a porous plate 54 that covers the upper part of the drain stored in a storage part 48 in a drain tank 40. The porous plate 54 is a thin plate provided with a plurality of small holes 54*a*. For example, the porous plate 54 may be a member such as a so-called punching metal formed by perforating a metal plate, or may be a member formed by perforating a resin plate having a specific gravity smaller than that of drain water.

The method of installing the porous plate 54 is not particularly limited, and may be fixed at a predetermined depth position of the storage part 48, or may be simply placed on the bottom of the storage part 48 so as to float when the drain is accumulated in the storage part 48.

By having the porous plate 54 provided, because the drain stored in the storage part 48 can be suppressed from being lifted by the flow of the gas, the drain can be more effectively suppressed from reaching a gas lead-out port 32 via a ventilation flow path 50.

Fifth Embodiment

Figure 8:
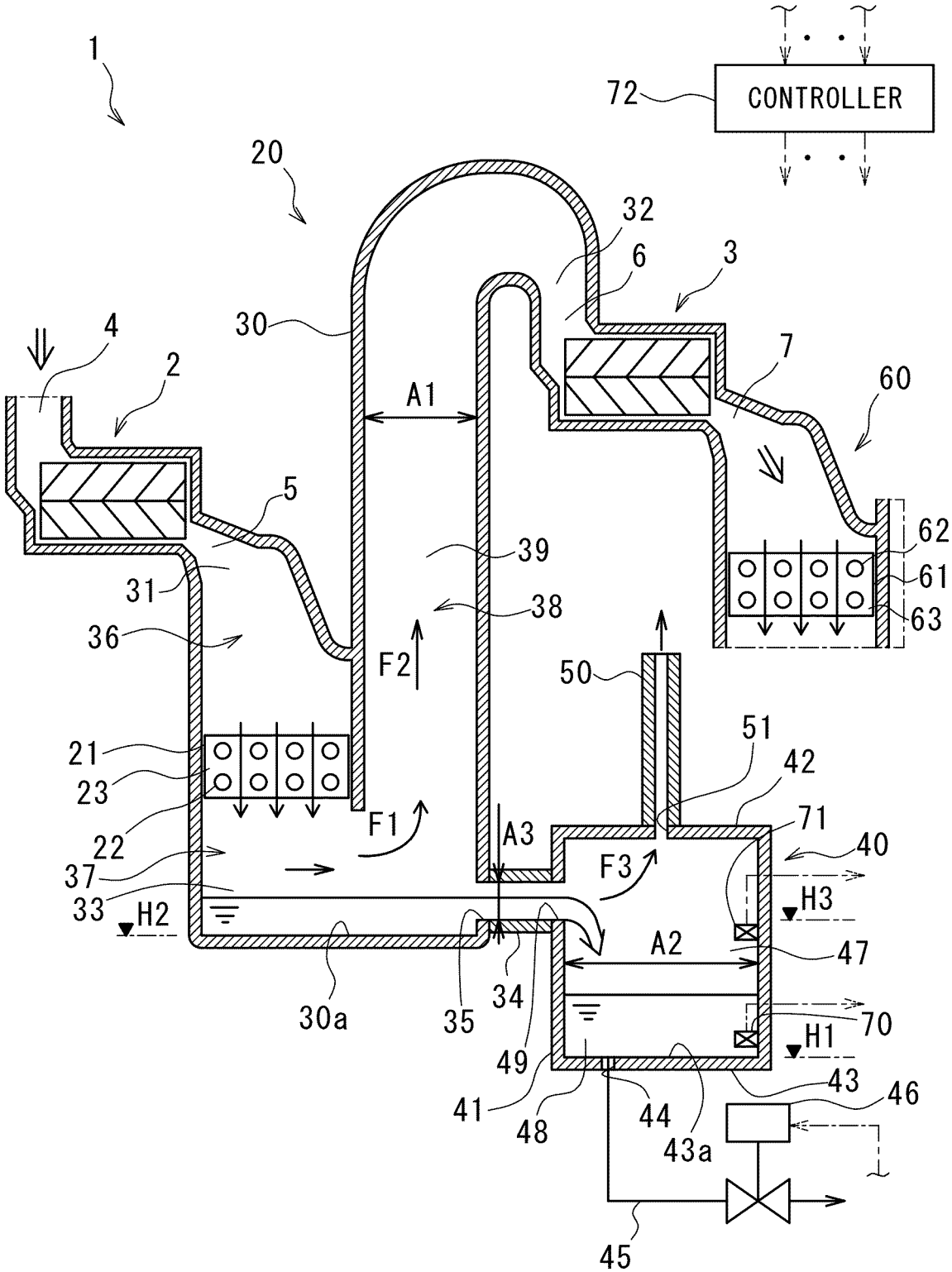
FIG. 8 is a schematic configuration diagram of a compressor including a gas cooler according to a fifth embodiment of the present invention.

Referring to FIG. 8, in the fifth embodiment, the other end of a ventilation flow path 50 is opened to the atmosphere instead of communicating with a gas lead-out port 32.

In the fifth embodiment, even in a case where the second flow cannot be returned to the first flow, the drain can be stored in the storage part.

Sixth Embodiment

Figure 9:
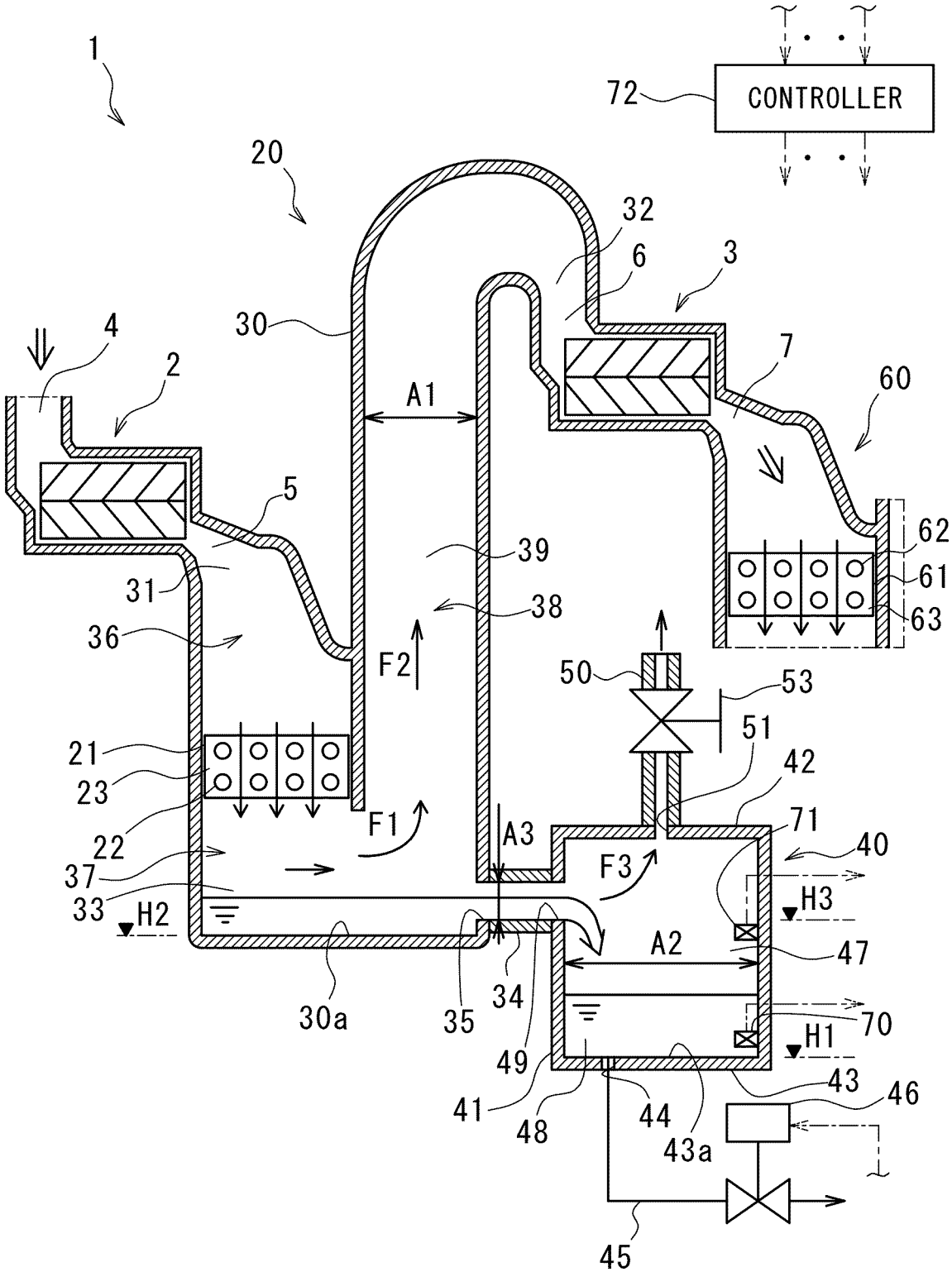
FIG. 9 is a schematic configuration diagram of a compressor including a gas cooler according to a sixth embodiment of the present invention.

Referring to FIG. 9, in the sixth embodiment, the distal end (the other end) of a ventilation flow path 50 is not connected to a casing 30 but is open to the atmosphere. In addition, an intercooler 20 in the sixth embodiment includes a throttle valve 53 that adjusts the flow rate of the gas passing through a ventilation flow path 50.

The throttle valve 53 has a function of adjusting the flow rate of the air passing through the ventilation flow path 50. Therefore, the flow rate V2 is appropriately set by adjusting the aperture of the throttle valve 53, and the velocity U1 and the velocity U2 can be adjusted.

In addition, in the sixth embodiment, even in a case where the second flow cannot be returned to the first flow, the drain can be stored in the storage part 48. In addition, the drain can be suppressed from being guided to a gas lead-out port 32 accompanying the first flow, by only adjusting the flow rate of the air passing through the ventilation flow path 50, that is, by only adjusting the loss of the air.

Although specific embodiments of the present invention and modifications thereof have been described above, the present invention is not limited to the above embodiments, and various modifications can be made within the scope of the present invention. For example, the casing 30, the drain discharge flow path 34, the drain tank 40, and the ventilation flow path 50 may be formed of individual members, or at least two or more of the above may be integrally formed like a cast product. Although the case where the inner bottom surface 30*a* of the casing 30 is horizontal has been exemplified, the inner bottom surface 30*a* may be formed so as to be lowered continuously or stepwise toward the drain outlet 35.

The invention claimed is:

1. A gas cooler comprising:

a casing provided with a gas introduction port and a gas lead-out port;

a cooling part that is provided in an inside of the casing, partitions the inside of the casing into an upstream space in which the gas introduction port is opened and a downstream space communicating with the gas lead-out port, and cools gas introduced into the inside of the casing;

a drain recovery part that is provided at a bottom part of the downstream space and accumulates drain separated from the gas by cooling the gas in the cooling part;

a drain tank including a separation part into which the drain accumulated in the drain recovery part is introduced together with a part of the gas and that separates the drain and the gas, a storage part that stores the drain that has been separated, and a drain discharge port configured to discharge the drain from the storage part;

a drain discharge flow path having one end communicating with the drain recovery part and the other end communicating with the separation part, the drain discharge flow path being configured such that the drain accumulated in the drain recovery part and a part of the gas always flow together from the drain recovery part to the drain discharge flow path; and a ventilation flow path having one end communicating with the separation part, and the other end communicating with a gas flow path that leads to the downstream space above the drain recovery part and to the gas lead-out port.

2. The gas cooler according to claim 1, wherein the gas flow path includes a first gas flow path extending upward from the drain recovery part and connecting the downstream space with the gas lead-out port, and the other end of the ventilation flow path communicates with the first gas flow path.

3. The gas cooler according to claim 2, wherein the first gas flow path, the separation part, the drain discharge flow path, and the ventilation flow path have flow path cross-sectional areas having a following relationship:

$$A2>A1>A3>A4$$

A1: A flow path cross-sectional area of the first gas flow path

A2: A flow path cross-sectional area of the separation part

A3: A flow path cross-sectional area of the drain discharge flow path

A4: A flow path cross-sectional area of the ventilation flow path.

4. The gas cooler according to claim 3, wherein velocities of gas in the first gas flow path and the separation part have a following relationship:

$$U1=V1/A1 \text{ (m/sec)}<U \text{ (m/sec)}$$

$$U2=V2/A2 \text{ (m/sec)}<U \text{ (m/sec)}$$

$$V=V1+V2$$

U: A terminal velocity

U1: A velocity of gas in the first gas flow path

U2: A velocity of gas in the separation part

V: A flow rate of gas guided to the drain recovery part

V1: A flow rate of gas guided to the first gas flow path

V2: A flow rate of gas guided to the separation part.

5. The gas cooler according to claim 1, wherein the drain tank has an inner bottom surface whose position in a height direction is relatively lower than a position of an inner bottom surface of the casing in the height direction, and the drain discharge flow path is opened on a side of the casing so as to include the position of the inner bottom surface of the casing in the height direction, and the drain discharge flow path has a bottom surface that is horizontal or downwardly inclined toward a side of the drain tank.

6. The gas cooler according to claim 1, further comprising a throttle valve that adjusts a flow rate of gas passing through the ventilation flow path.

7. The gas cooler according to claim 1, further comprising a porous plate that covers an upper part of the drain stored in the storage part in the drain tank.

8. The gas cooler according to claim 1, wherein the other end of the ventilation flow path is opened to an atmosphere instead of communicating with the gas lead-out port.

9. The gas cooler according to claim 2, wherein the drain tank has an inner bottom surface whose position in a height direction is relatively lower than a position of an inner bottom surface of the casing in the height direction, and the drain discharge flow path is opened on a side of the casing so as to include the position of the inner bottom surface of the casing in the height direction, and the drain discharge flow path has a bottom surface that is horizontal or downwardly inclined toward a side of the drain tank.

10. The gas cooler according to claim 3, wherein the drain tank has an inner bottom surface whose position in a height direction is relatively lower than a position of an inner bottom surface of the casing in the height direction, and the drain discharge flow path is opened on a side of the casing so as to include the position of the inner bottom surface of the casing in the height direction, and the drain discharge flow path has a bottom surface that is horizontal or downwardly inclined toward a side of the drain tank.

11. The gas cooler according to claim 4, wherein the drain tank has an inner bottom surface whose position in a height direction is relatively lower than a position of an inner bottom surface of the casing in the height direction, and the drain discharge flow path is opened on a side of the casing so as to include the position of the inner bottom surface of the casing in the height direction, and the drain discharge flow path has a bottom surface that is horizontal or downwardly inclined toward a side of the drain tank.

* * * * *